US005881434A

United States Patent [19]

Rigney

[11] Patent Number: 5,881,434

[45] Date of Patent: Mar. 16, 1999

[54] IMPLEMENT HOLDER

[76] Inventor: Douglas E. Rigney, 789 Charleton Dr., Pleasant Hill, Calif. 94523

[21] Appl. No.: 965,879

[22] Filed: Nov. 7, 1997

[51] Int. Cl.[6] ..... A47B 19/00; A60R 7/00

[52] U.S. Cl. ..... 24/11 R; 24/67.9; 24/531; 24/563; 248/447.2

[58] Field of Search ..... 24/67.9, 67.11, 24/110 R, 11 R, 3.11, 3.12, 317, 319, 602, 115 F, 343, 531, 563, 460, 459, 455, 570; 211/69.1, 69.9, 69.8, 69.2, 60.1; 116/234, 237, 238, 239; 248/205

[56] References Cited

U.S. PATENT DOCUMENTS

| | | | |
|---|---|---|---|
| 155,196 | 9/1874 | McNair . | |
| D. 352,963 | 11/1994 | Siler | D19/83 |
| 636,269 | 11/1899 | Long | 24/67.9 |
| 637,889 | 11/1899 | Parker . | |
| 803,464 | 10/1905 | Beck . | |
| 884,256 | 4/1908 | Addie . | |
| 1,392,119 | 9/1921 | Corbin . | |
| 1,428,900 | 9/1922 | Oppenheimer | 24/67.9 |
| 1,491,286 | 4/1924 | Calhoun | 24/563 X |
| 1,506,147 | 8/1924 | Abbott | 24/531 X |
| 1,521,451 | 12/1924 | Spencer | 24/561 X |
| 1,544,016 | 6/1925 | Lyman | 211/69.1 |
| 1,711,730 | 5/1929 | Gibson . | |
| 1,958,934 | 5/1934 | Williams | 24/531 X |
| 2,300,216 | 10/1942 | Grodsky | 116/119 |
| 2,344,613 | 3/1944 | Hellstern | 116/119 |
| 2,549,200 | 4/1951 | Hooks | 24/67.9 |
| 2,609,578 | 9/1952 | Andary | 24/531 X |
| 2,670,221 | 2/1954 | Wellendorf . | |
| 3,513,806 | 5/1970 | Ferrick | 116/119 |
| 3,564,668 | 2/1971 | Kirk | 24/81 |
| 3,968,546 | 7/1976 | Seaborn et al. | 24/67.9 |
| 3,983,602 | 10/1976 | Barry | 24/11 R |
| 4,077,521 | 3/1978 | Alkins | 24/343 X |
| 4,162,800 | 7/1979 | Gonot | 281/42 |
| 4,738,007 | 4/1988 | Demarest, Jr. | 24/67.9 |
| 4,838,198 | 6/1989 | Knox | 116/239 |
| 4,934,304 | 6/1990 | Rosen | 116/237 |
| 4,948,172 | 8/1990 | Chang | 281/45 |
| 4,982,685 | 1/1991 | Abe | 116/327 |
| 5,016,559 | 5/1991 | Larson | 116/324 |
| 5,050,830 | 9/1991 | Hall | 248/205.2 |
| 5,072,686 | 12/1991 | Falco | 116/324 |
| 5,093,760 | 3/1992 | Bedol | 361/392 |
| 5,145,140 | 9/1992 | Caston et al. | 248/447.2 |
| 5,259,095 | 11/1993 | Tam | 24/10 R |
| 5,366,070 | 11/1994 | Wolov | 206/214 |

*Primary Examiner*—Anthony Knight
*Assistant Examiner*—Robert J. Sandy
*Attorney, Agent, or Firm*—John Brady

[57] ABSTRACT

An apparatus for holding articles, such as writing instruments, in cooperation with a surface, such as a book cover, comprising a flat support member, a clamp element and an article retaining portion. The article retaining portion is comprised of a strip of resilient material bent into a serpentine profile and includes in succession along its length a first bend portion transverse to the support member, a proximal bend portion, a first arcuate bend portion, a distal band portion, and a second arcuate bend portion. The first and second arcuate bend portions define article retaining channels and the facing internal surfaces of the proximal and distal bend portions cooperate to form another space for holding articles. An optional bookmarker is suspended from the article retaining portion in an orientation suitable for insertion between the pages of a book.

11 Claims, 3 Drawing Sheets

IMPLEMENT HOLDER

TECHNICAL FIELD

This invention relates to devices for holding articles in association with an object. More specifically, the invention concerns a particular arrangement of the components of a holder to provide an improved apparatus for releasibly holding a plurality of articles having various dimensions, including writing instruments, adjacent to a flat surface such as a book cover.

BACKGROUND ART

Persons reading books sometime desire to underline sentences or passages for future reference using a pen or pencil. In some cases the person will use a felt tip highlighter or marking pen for distributing a broad colored transparent line over the printing in the book. It would be convenient therefore to be able to store a plurality of such instruments in association with a book cover, clipboard, loose-leaf notebook cover or similar plate-like surface. The ability to retain other articles or implements such as an eraser, flashlight, lighter, tools or utensils in association with surfaces such as a tray, sun visor, or belt, would also be desirable.

A review of the prior art describes several implement holders, but none provide the advantages of the present invention. Many of the prior art devices accommodate only a single pencil or pen. In U.S. Pat. No. 5,072,686 (1991), Falco describes a combination bookmark and pen holder which retains a range of different diameter pens. However, the device does not incorporate means for attachment to a surface, and retains only a single pen. In U.S. Pat. No. 3,564,668 (1971), Kirk describes an apparatus which holds a plurality of pens or pencils within a series of parallel semi-tubular clips. However, the adjacent clips are supported on the outer surface of the book cover and would therefor interfere with carrying the book or with stacking of the book against other books or surfaces. In addition, the clips are susceptible to being bent or broken.

None of the above inventions and patents taken either singly or in combination is seen to describe the instant invention as claimed. Accordingly, it is among the objects of the present invention to provide a novel article holder and bookmark device which is compact, simple to manufacturer, and economical in cost. Another objective of the present invention is to provide a holder which may be releasibly attached to the edge portion of the cover of a book or other surface. Still another objective is to provide a holder for accommodating a plurality of articles of varied dimensions.

SUMMARY OF THE INVENTION

The apparatus in accordance with the present invention includes a generally planar support member for contacting a flat surface, such as the inside of a book cover, and a clamp element for releasibly attaching the support member to an edge of the flat surface. Attached to the support member, an article retaining portion comprising a strip of resilient material bent in a compact serpentine profile includes arcuate bend portions and cooperatively facing internal bend portions which provide a plurality of spaces and channels for retaining articles of various dimensions. In the preferred embodiment, the serpentine portion is bent in succession along its length into a first bend portion which is transverse to the support member, a proximal bend portion, a first arcuate bend portion, a distal bend portion, and a second arcuate bend portion. The first and second arcuate bend portions define article retaining channels and the facing internal surfaces of the proximal and distal bend portions cooperate to form another channel for holding articles. A bookmarker is suspended from the first bend portion in a direction suitable for insertion between the pages of a book.

DETAILED DESCRIPTION OF THE DRAWINGS

Figure 1:
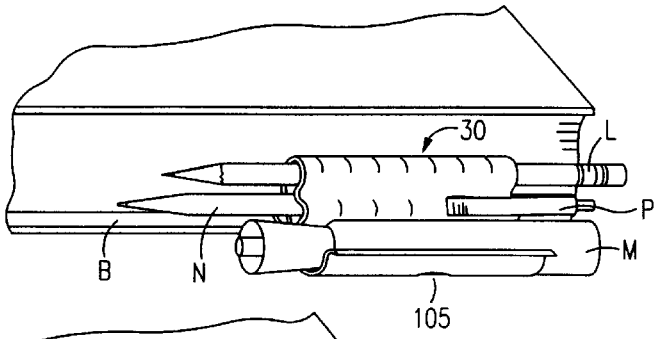
FIG. 1 is a perspective drawing of an apparatus mounted within a book in accordance with the present invention demonstrating storage of a pencil L, a pen N, and a marking pen M.

Referring to the drawings 1–6, an apparatus 30 in accordance with the present invention broadly includes generally planar element 32 and serpentine portion 34 integrally attached to the planar element. The planar element and serpentine portion are preferably of a flexible resilient material such as plastic or metal. The apparatus may be formed by the bending of a continuous sheet of material or by injection molding. The planar element and serpentine portion alternatively may be formed as separate components and attached together by known means such as rivets, welding or adhesive. Slits 35 may be provided for supporting a notepad, paper clip, card, coin or similar small item.

Figure 3:
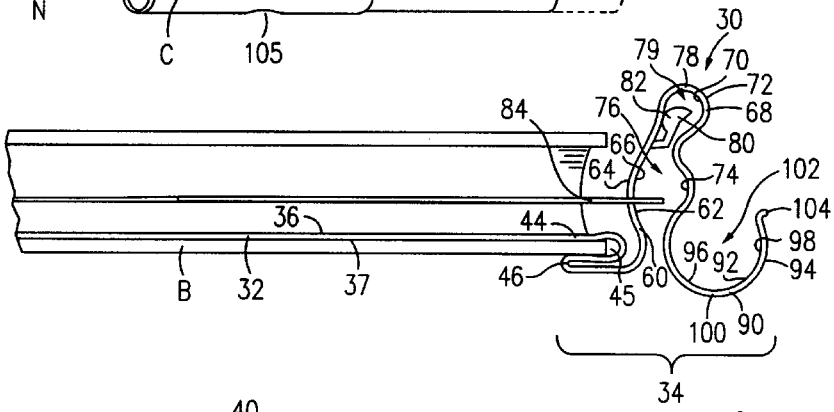
FIG. 3 is a side view of the apparatus of FIG. 1 but without the writing instruments retained therein.
Figure 4:
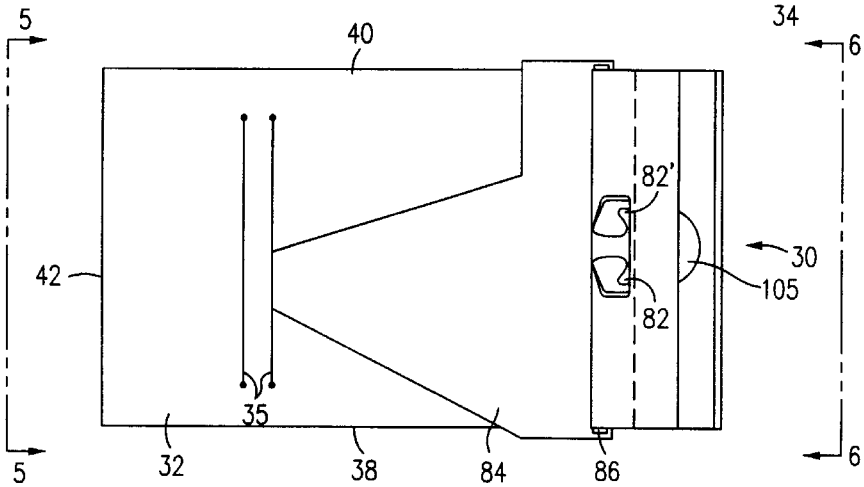
FIG. 4 is a plan view of the apparatus of FIG. 3 but removed from the book.
Figure 5:
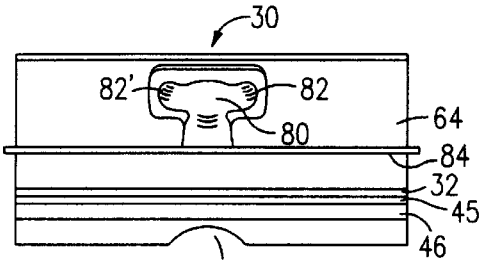
FIG. 5 is an end view of the apparatus of FIG. 4 taken in the direction of the arrows 5—5 of FIG. 4.
Figure 6:
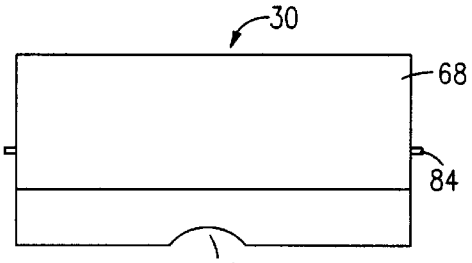
FIG. 6 is an end view of the apparatus of FIG. 4 taken in the direction of the arrows 6—6 in FIG. 4.
Figure 7:
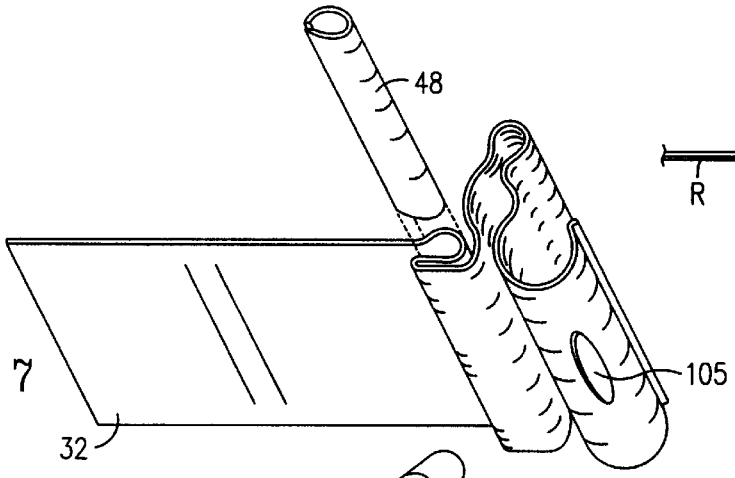
FIG. 7 is a bottom perspective view of the holder of FIG. 3, but without the bookmarker, and demonstrating the application of a slide out clip.
Figure 8:
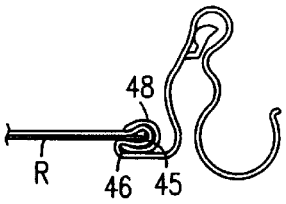
FIG. 8 is a side view of the clamp element of the apparatus of FIG. 7 with the slide out clip in place and in association with a thin planar surface R.

The planar element includes top and bottom surface 36,37 opposed side margins 38,40 a free end 42 and an attachment portion 44. Referring to FIG. 4, the planar element is preferable 3 and ¾ inches in length and 3 inches in width such that it may engage a flat surface such as a book cover B within slot 45. In FIGS. 3, 7 and 8, the serpentine portion 34 incorporates a reverse bend lip 46 as a clamp element for cooperating with the planar element and for engaging an edge of the book cover. In the present invention, the serpentine portion is disposed beyond the perimeter of the flat surface as defined by the edge, e.g., beyond the surface of a book cover, as shown in FIG. 3.

Referring to FIGS. 7 and 8, a slide out clip 48 is used to urge the bottom surface of the planar portion and the reverse bend lip into closer proximity and thereby adjust the clamp element to accommodate a relatively thin planar surface, such as the cover of a paperback book R. In a second embodiment of the apparatus as shown in FIGS. 9 –12, the clamp element includes retaining clips 50,50' mounted to the bottom surface of the planar element 32 for engaging an edge of a book cover B or other planar surface.

Referring to FIG. 3, the serpentine portion 34 includes a first transverse bend element 60 which has an inner surface 62 and an outer surface 64. The wall of the first transverse bend element includes a curve at first internal proximal bend portion 66. The first transverse bend element extends distally to form a reverse transverse bend element 68 which has an inner surface 70 and outer surface 72. The wall of the reverse transverse bend element includes a curve at a first internal distal bend portion 74. As shown in FIG. 3, the first internal proximal bend portion 66 and the first internal distal portion 74 cooperate to define a first article retaining channel 76. As shown in FIG. 3, the reverse transverse bend element includes a proximal arcuate portion 78 the concave side of which defines a second article receiving channel 79. As shown in FIG. 3 and 4, a bookmarker 84 having a slot 86 is suspended from the first transverse bend element and extends toward the free end of said planar element. The bookmark preferably is formed of leather, vinyl or rubber.

Figure 13:
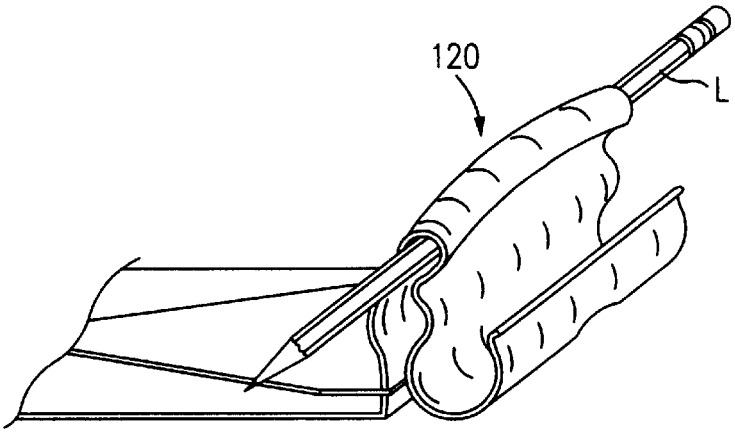
FIG. 13 is a perspective view of a third embodiment of the apparatus of the present invention.
Figure 14:
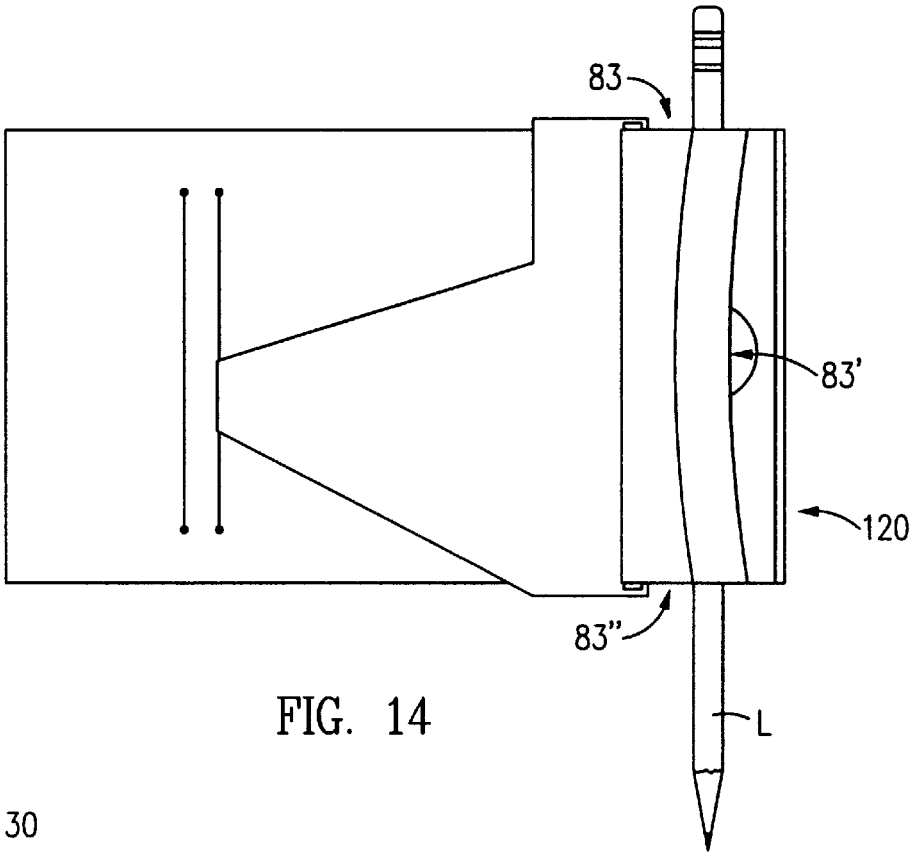
FIG. 14 is a plan view of the apparatus of FIG. 13.

A retaining means is incorporated within the concave side of said proximal arcuate portion. A non-limiting example of a retaining means is a T-shaped resilient clip 80 which extends axially into the concave side of said proximal arcuate portion. The tips of the horizontal of the T comprise ears 82,82' which are bent backwards as seen in FIGS. 3 and 4. Referring to FIGS. 13 and 14, in a third embodiment 120 of the apparatus, channel 79 is arched to provide frictional contact points at 83, 83', 83".

Referring to FIG. 3, the reverse transverse bend element extends distally to form a second transverse bend element 90 having an inner surface 92 and an outer surface 94. The second transverse element includes second internal proximal bend portion 96 and second internal distal bend portion 98. In the embodiment shown in FIG. 3, the second transverse bend element includes a distal arcuate portion 100 the concave side of which defines a third article receiving channel 102. The second transverse bend element extends distally to form lip 104.

Figure 15:
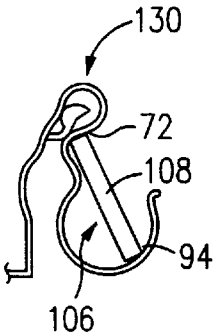
FIG. 15 is a partial side view of a fourth embodiment of the apparatus of the present invention.

In a fourth embodiment 130 as illustrated in FIG. 15, the outer surface 72 cooperates with the inner surface 94 to form a receiving space for an article 108 having a non-cylindrical profile.

Figure 2:
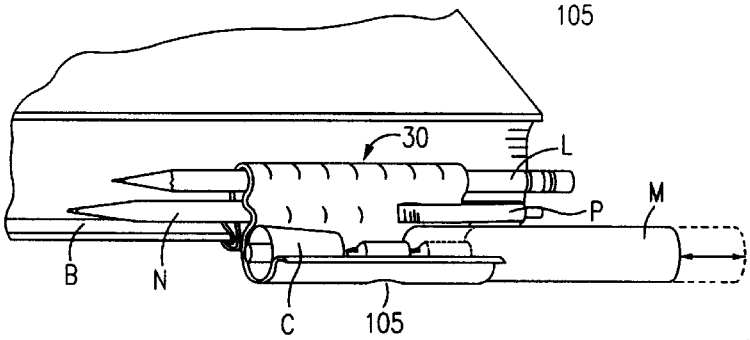
FIG. 2 is a perspective drawing of the apparatus of FIG. 1 but demonstrating separate storage of a marking pend and its cap C.

In operation and referring to FIGS. 1–3, writing instruments may be inserted from either side of the apparatus for retention in the first article receiving channel 76, the walls of which channel provide for the attachment of those writing instruments or other articles having a pocket clip P or similar attachment device.

A writing instrument or similarly shaped article may be inserted from either side of the second article receiving channel 79. The article frictionally engages the T shaped resilient clip 80 by pushing it outwardly and toward the free end of the planar element. Ears 82, 82 ' are bent backwards to deflect the application of sideways force to the resilient clip and to facilitate the desired outward movement of the resilient clip. Referring to FIGS. 13 and 14, another means for frictionally engaging an article L within receiving channel 79 comprises the formation of an arched or bowed channel, as seen in the third embodiment 120, and result in frictional contact points 83, 83', 83" between an inserted article and the inner surfaces of the channel.

Referring to FIG. 1, a marking pen M with cap C may be inserted between the lip 104 and the outer surface 72. The marking pen enters into the third receiving channel 102 and is snapably retained in place therein. Removal of the marker is facilitated by manually pushing the marker through cutout 105. As shown in FIGS. 1 and 2, the marker may be stored in a capped or uncapped position. The cap C may be stored separately of the marker pen within the holder thereby reducing the chance of misplacing the cap. With the cap thusly stored, the marker pen preferably is inserted or withdrawn from the third receiving channel 102 from the side of the holder in a manner as indicated by the double headed arrow in FIG. 2.

Figure 9:
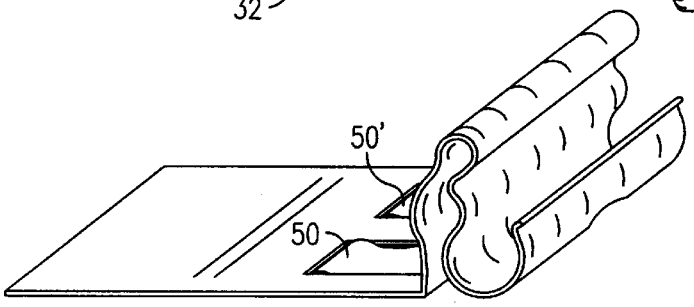
FIG. 9 is a top perspective view of a second embodiment of the apparatus of the present invention.
Figure 11:
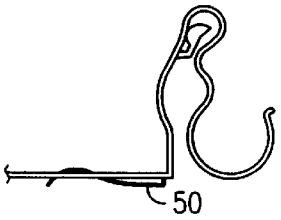
FIG. 11 is a partial side view of the apparatus of the apparatus of FIG. 9.
Figure 10:
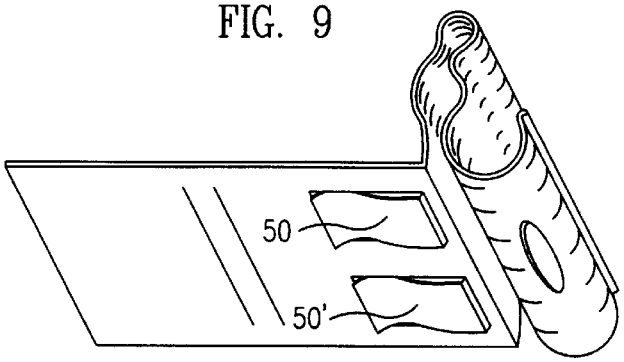
FIG. 10 is a bottom perspective view of the apparatus of FIG. 9.
Figure 12:
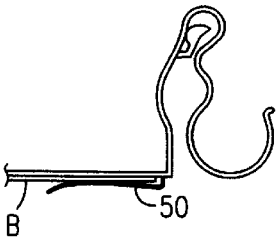
FIG. 12 is a partial side view of the apparatus of FIG. 9 mounted to a flat surface.

When used in conjunction with a book, the apparatus may be mounted on the front or back cover and on either one of the top, side or bottom edges, with the planar element on the inside of the cover. As seen in FIGS. 3, 9 and 10 the book cover is inserted to engage the clamp element and contact the bottom surface of the planar element. The apparatus will then be held in place against accidental displacement. When placed at the side edge of a book as shown in FIGS. 1–3, the bookmarker 84 may be used to mark paragraphs on a page by sliding the apparatus along the edge until it rests overlapping the desired area of text.

Figure 16:
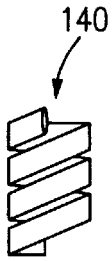
FIG. 16 is a side view of a flexible spiral element.
Figure 17:
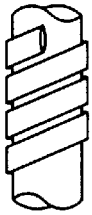
FIG. 17 is a side view of a flexible spiral element engaging an article.

Some articles may have dimensions too small to be retained within the apparatus. Flexible elements such as spiral coiled elements 140 as shown in FIGS. 16 and 17, or other adapters, may be utilized to increase the effective circumference of the articles to be held within the apparatus as needed.

What is claimed is:

1. An apparatus for attachment to an object and for holding articles adjacent to said object comprising:

a) a planar element for engaging and extending along generally flat surface of said object, said surface having an edge, b) a clamp element cooperating with said planar element for engaging said edge, c) a serpentine portion disposed beyond the perimeter of said surface as defined by said edge comprising:

i) a first transverse bend element extending from said clamp element including portions defining a first internal proximal bend portion, ii) a reverse transverse bend element extending from said transverse bend element including portions defining a first internal distal bend portion, iii) a second transverse bend element extending from said reverse transverse bend element including portions defining a second internal proximal bend portion and a second internal distal bend portion, d) said first transverse bend element, said reverse transverse bend element, and said second transverse bend element being adapted for enclosing a portion of and for retaining said articles adjacent to said object.

2. The apparatus of claim 1 wherein said first and said second transverse bend elements define internal and external bend portions for separately supporting individual articles adjacent to said object.

3. The apparatus of claim 1 wherein said reverse transverse bend element includes a proximal arcuate portion, and wherein said second transverse bend element includes a distal arcuate portion, each of said arcuate portions having a concave side, the concave side of each of said arcuate portions defining a channel for separately retaining individual articles adjacent to said object.

4. The apparatus of claim 3 further including a resilient clip with ears formed in said first internal proximal bend portion.

5. The apparatus of claim 4 wherein said resilient clip extends into the concave side of said proximal arcuate portion for retaining an article.

6. The apparatus of claim 3 wherein said channel of said proximal arcuate portion is arched.

7. The apparatus of claim 1 wherein said first internal proximal bend portion and said first internal distal bend portion cooperate to define a retaining space.

8. The apparatus of claim 1 further including flexible elements for engaging articles being supported within said serpentine portion.

9. The apparatus of claim 8 wherein said flexible elements are spiral coiled elements for engaging at least a portion of an article being supported within said apparatus.

10. The apparatus of claim 1 including a slide out clip cooperating with said clamp element.

11. The apparatus of claim 1 further comprising means along said planar element for supporting a note pad.

* * * * *